United States Patent [19]

Sasaki et al.

[11] Patent Number: 5,059,998

[45] Date of Patent: Oct. 22, 1991

[54] PROCESSING SOLUTION SUPPLEMENTING APPARATUS AND METHOD

[75] Inventors: Kouichi Sasaki; Takashi Nakamura, both of Kanagawa, Japan

[73] Assignee: Fuji Photo Film Co., Ltd., Kanagawa, Japan

[21] Appl. No.: 501,822

[22] Filed: Mar. 30, 1990

[30] Foreign Application Priority Data

Mar. 31, 1989 [JP] Japan ..... 1-78519

[51] Int. Cl.[5] ..... G03D 3/06

[52] U.S. Cl. ..... 354/324; 354/321; 137/487.5; 137/624.11

[58] Field of Search ..... 354/298, 321, 324; 355/27; 137/392, 486, 487.5, 624.11, 624.13

[56] References Cited

U.S. PATENT DOCUMENTS 3,841,351 10/1974 Shida ..... 354/324 X
4,480,901 11/1984 Osegowitsch et al. ..... 354/324 X
4,769,662 9/1988 Suzuki et al. ..... 354/324

*Primary Examiner*—A. A. Mathews
*Attorney, Agent, or Firm*—Sughrue, Mion, Zinn, Macpeak & Seas

[57] ABSTRACT

A processing solution supplying apparatus and method for supplementarily supplying a processing solution into a processing vessel for processing a photographic photosensitive material. The quantity of supply of the processing solution is detected, and a series of pulses with a predetermined period produced in correspondence to the quantity of supply thus detected. These pulses are counted for a predetermined period of time. The time of stopping the operation of the processing solution supplying pumps is determined according to the number of pulses thus produced or counted.

7 Claims, 7 Drawing Sheets

PROCESSING SOLUTION SUPPLEMENTING APPARATUS AND METHOD

BACKGROUND OF THE INVENTION

The present invention relates to a processing solution supplementing apparatus and method for supplementarily supplying processing solutions to processing solution vessels used for processing operations, such as developing, bleaching and fixing-of a photographic photosensitive material which has been exposed to light reflected from or passed through an original or to light obtained from electrical signals through photoelectric conversion.

In general, when, in an automatic developing unit using silver halogenide photographic photosensitive materials, a processing solution such as a developing solution is supplementarily supplied into the processing vessel, the quantity of supplement thereof is calculated according to the size and amount of photographic photosensitive materials to be optically exposed. That is, the processing solution is supplementarily supplied according to the total processing area of the photosensitive materials so that the latter can be continuously processed in a desired manner.

Generally, images formed by exposing photographic photosensitive materials differ in density from one another, and the densities of the images depend on the exposure conditions. Even if the images are equal in size, they are generally different in the amount of exposure. Accordingly, photographic photosensitive materials different in the amount of exposure differ in developing rate. The developing rate is one of the factors which greatly affects the required amount of supplimentation of the developing solution. That is, as the developing rate is increased, the developing capacity is decreased quicker. Thus, for a high developing rate, it is necessary to supplementarily supply a large quantity of developing solution. Such a requirement occurs for instance in the case where a number of originals high in density are processed. On the other hand, when the developing rate is low, only a small quantity of developing solution need be supplementarily supplied into the developing vessel, as in the case of processing a number of originals low in density.

Hence, if supplementation of the processing solution is carried out according only to the area which is to be processed, then the processing solution may be excessively supplied. As a result, the photosensitive material is not processed under the designated processing conditions, and accordingly it may not be satisfactorily finished. Therefore, it is necessary for the operator to visually inspect the finish of the photographic photosensitive material every certain period of time, thereby to control the quantity of supplement of processing solution. Thus, the operation of the conventional developing apparatus is troublesome. Especially with a color copying machine of a silver salt photographic type installed in many offices for instance, it is rather difficult for the operator to manually correct the quantity of supplement of processing solution.

On the other hand, Japanese Patent Application No. 232593/88 has disclosed an apparatus in which the quantity of supply of processing solution is calculated according to various factors other than the processing area, thereby to maintain the processing solution in the processing vessel unchanged in characteristic. This is incorporated by reference to the co-pending U.S. patent application Ser. No. 07/381,401.

For supplementing the processing solution in the processing vessel, for instance a pump can be operated to supply the processing solution into the processing vessel, or the processing solution may be allowed to freely drip into the processing vessel. In the former method, the operation of the pump is controlled to supply a correct quantity of processing solution. In the latter method, the operation of a valve for allowing the processing solution to drip is controlled.

However, those methods are disadvantageous in that even if the operation of processing solution supplying device such as a pump and valve is controlled according to a calculated quantity of supplementation of processing solution, sometimes the processing solution may not be supplied correctly in the calculated quantity of supplement because of an error in the quantity of supply or erroneous operation of the processing solution supplying device. Also, sometimes the capacity of the processing solution supplying means may make it impossible to supplementarily supply a sufficient quantity of the processing solution. Accumulation of small errors in the quantity of supply can result in a large error, thus obstructing correct supplementation of the processing solution. Hence, the operation of the processing solution supplying device must be high in reliability.

SUMMARY OF THE INVENTION

In view of the foregoing, an object of the invention is to eliminate the above-described difficulties. More specifically, an object of the invention is to provide a processing solution supplementing apparatus and method which can supplementarily supply a correct quantity of processing solution with high reliability.

The foregoing and other objects of the invention have been achieved by the provision of a processing solution supplementing apparatus for supplementarily supplying a processing solution into a processing vessel for processing a photographic photosensitive material, and a method for operating such an apparatus, which, according to a first aspect of the invention, comprises: detecting means for detecting a quantity of supply of the processing solution, pulse generating means for producing pulses with a predetermined period in correspondence to the quantity of supply thus detected, and control means for controlling the time of stopping the operation of processing solution supplying means according to the number of pulses thus produced.

With the inventive apparatus and method, the calculated quantity of supply of processing solution is detected and converted into pulses with a predetermined period, and when the number of pulses reaches a predetermined value, the operation of the processing solution supplying means is suspended. Thus, the calculated quantity of supplement of processing solution can be supplied with high accuracy.

In addition, the above-described object of the invention has been achieved by the provision of a processing solution supplementing apparatus for supplementarily supplying a processing solution into a processing vessel for processing a photographic photosensitive material, and a method for operating such an apparatus, which, according to a second aspect of the invention, comprises: pulse generating means for converting a calculated quantity of supplement of the processing solution into pulses, processing solution supplying means the time of operation of which is controlled according to a predetermined number of pulses, memory means for temporarily storing the difference between the number of pulses produced by the pulse generating means and the number of pulses concerning control of the processing solution supplying means, arithmetic means for adding the number of pulses thus stored to a number of pulses corresponding to the next calculated quantity of supplement of the processing solution, and control means for controlling the operation of the processing solution supplying means according to a result of operation by the arithmetic means.

With the apparatus and method according to the second aspect of the invention, the error in the quantity of supplement of processing solution attributed to the capacity of the processing solution supplying means is stored as a number of pulses, and in the next supplementing operation the number of pulses corresponding to the error is added to the number of pulses corresponding to the calculated quantity of supplement of processing solution to control the operation of the processing solution supplying means. Thus, the error is eliminated by repeatedly performing supplementation of processing solution.

Furthermore, objects of the invention have been achieved by the provision of a processing solution supplying apparatus for supplementarily supplying a processing solution into a processing vessel for processing a photographic photosensitive material, and a method for operating such apparatus, which, according to a third aspect of the invention, comprises: detecting means for detecting a quantity of supply of the processing solution, pulse generating means for producing pulses with a predetermined period in correspondence to the quantity of supply thus detected, counting means for counting pulses produced for a predetermined period of time, and control means for controlling the time of stopping the operation of the processing solution supplying means according to the number of pulses thus produced or the number of pulses thus counted.

With the above apparatus and method, the time of stopping the operation of the processing solution supplying means is controlled according to the number of pulses corresponding to the quantity of supply or the number of pulses counted for the predetermined period of time. Therefore, the apparatus is free from the difficulty that, when the number of pulses varies greatly because of a failure, the processing solution supplying means is kept in operation, causing an excessive supply of the processing solution.

Thus, according to the invention, the calculated quantity of processing solution can be supplementarily supplied into the processing solution vessel with high reliability.

The term "processing solutions" for photographic photosensitive materials as used herein is intended to mean solutions in which a photographic photosensitive material is immersed so as to be processed as required, such as color developing solutions, monochromatic (black and white) developing solutions, bleaching solutions, bleaching and fixing & solutions, fixing solutions and stabilizing solutions.

The invention is applicable to the processing of a color photosensitive material.

Typical examples of the color photosensitive material are a color print film, a slide or television color reversal film, and a color reversal paper. The invention can be applied to the processing of a black and white photosensitive material which is based on the three color coupler mixing technique which is disclosed by the publication "Research Disclosure" No. 17123 (July 1978) for instance.

In addition, the invention is applicable to the processing of a monochromatic photographic photosensitive material.

When a positive photographic photosensitive material is used directly in the invention, an optical fogging method and/or a chemical fogging method is employed for fogging treatment.

A total exposure in the optical fogging method, i.e., a fogging exposure, is carried out after an image-exposing operation and before or during a developing operation. The photosensitive material image-exposed is immersed in a developing solution or in the pre-bath of the developing solution, or it is taken out of the solution, and then exposed before dried. However, it is most preferable to subject it to exposure in the solution.

A nucleating agent used in a chemical fogging method can be contained in the photosensitive material or in the photo-sensitive material processing solution. However, it is preferable to provide the nucleating agent in the photosensitive material.

The term "nucleating agent" as used herein is intended to mean a material which acts in the surface treatment of an internal latent-image type silver halogenide emulsion not fogged to directly form a positive image. In the invention, it is preferable to perform the fogging treatment using a nucleating agent.

In providing the nucleating agent in the photosensitive material, preferably it is added to the internal latent-image type silver halogenide emulsion layer. However, it may be added to other layers such as an intermediate layer, base layer and back layer, as long as the nucleating agent is adsorbed by the silver halogenide being diffused during coating or processing.

In the case where the nucleating agent is added to the processing solution, it may be added to a developing solution or a low Ph pre-bath such as that disclosed in Japanese Unexamined Published Patent Application No. 178350/1983.

In accordance with the invention, more than one nucleating agent may be employed in combination.

In order to accelerate the action of the nucleating agent, a nucleation accelerating agent may be used. Tetrazaindenes, triazaindenes or pentazaindenes, which have at least one mercapto group radical replaceable with an alkaline metal atom or ammonium radical, or a compound as described in Japanese Unexamined Published Patent Application No. 106656/1988 may be added to the nucleation accelerating agent.

DESCRIPTION OF THE PREFERRED EMBODIMENTS

Preferred embodiments of the invention will be described with reference to the accompanying drawings.

Figure 1:
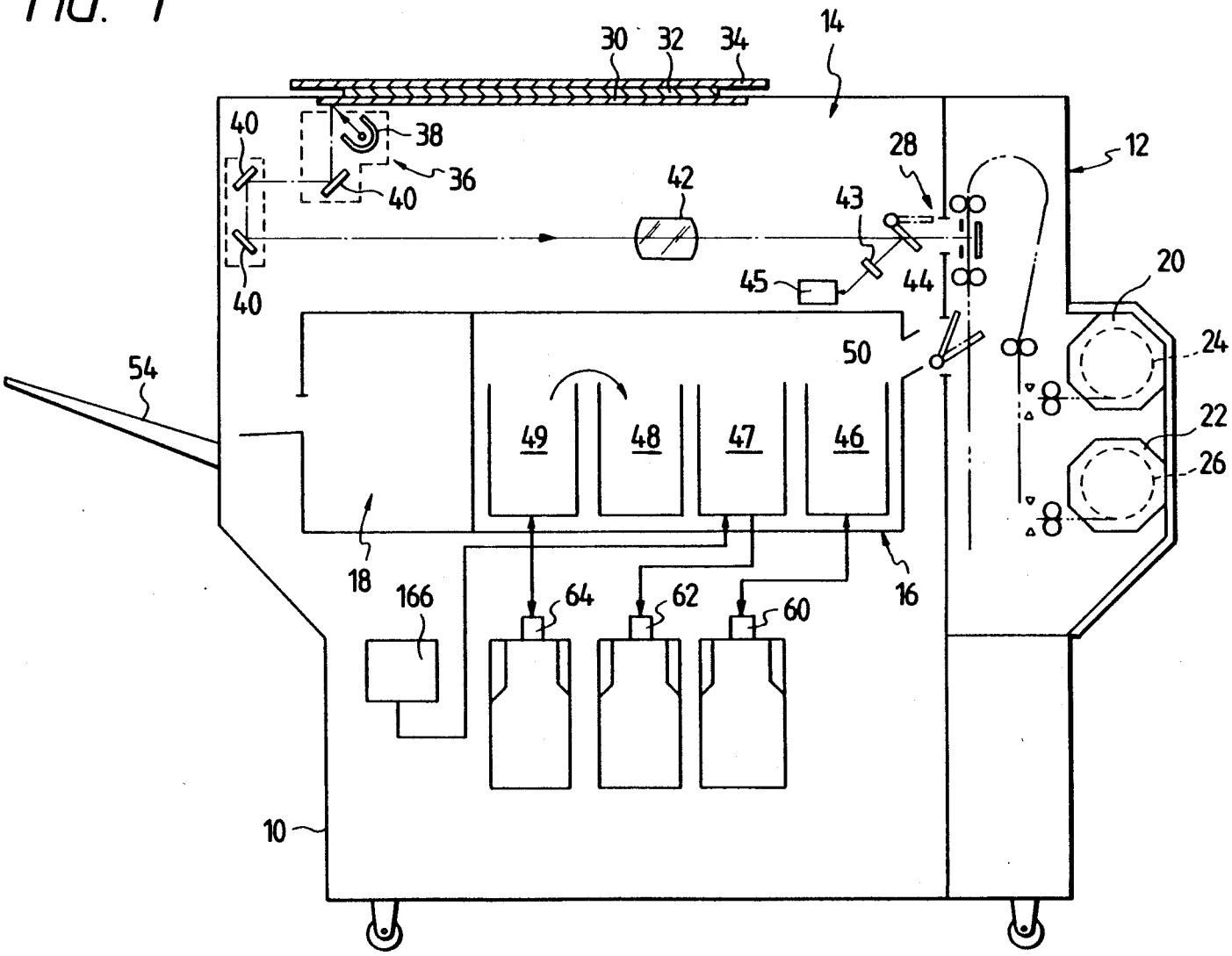
FIG. 1 is a diagram showing the arrangement of a color copying machine of silver salt photographic type.

FIG. 1 is a diagram outlining the arrangement of a color copying machine of silver salt photographic type. The copying machine body 10 has a sheet supplying section 12 and a drying section 18 which occupy the right and left portions of the body 10, respectively, and an exposing section 14 and a processing section 16 which occupy the upper portion of the body 10. A pair of magazines 20 and 22 are loaded in the color copying machine in such a manner that the former magazine 20 is held above the latter magazine 22. Photosensitive materials 24 and 26, each in the form of a roll, are accommodated in the magazines 20 and 22, from which they are introduced to the sheet supplying section. For instance, the photosensitive material 24 may be a material suitable for copying color picture originals, and the photosensitive material 26 is one suitable for copying color print originals. In the color copying machine, the two photosensitive materials 24 and 26 are processed in the same manner. Therefore, hereinafter only the processing of the photosensitive material 24 will be described.

The photosensitive material 24 pulled out of the magazine 20 is supplied through the sheet supplying section 12 to an exposing window 28, where it is optically exposed to a color original placed on an original stand 30. The color original 32 is pushed against the original stand 30 by an original retainer 34, and irradiated by the light source 38 of a light source unit 36. The light reflected from the color original is reflected by a plurality of mirrors 40 so that the image of the color original 32 is applied through an optical unit 42 to the photosensitive material 24 at the exposing window 28 when a shutter 44 is opened.

A switching guide 50 is provided in a photosensitive material conveying path (downstream of the exposing window 28 in FIG. 1) so as to change the direction of conveyance of the photosensitive material 24 when necessary; that is, the photosensitive material 24 conveyed downwardly is guided to the processing section 16 when required. When the shutter 44 is held closed, light beams reflected from a reference white board and the original are detected by a plurality of photosensors (six photosensors in this embodiment), and a control device 45 determines exposure control data according to the reflection density which is obtained from the white level value and the image photometric value outputted by those photosensors.

In the present embodiment, two photosensors are provided for each of the primary three colors, red (R), green (G) and blue (B). The average of the output photometric values of those photosensors is the aforementioned reflection density. The photometric density is 2.0 at the maximum in this embodiment.

The control device 45 operates to control various functions of the copying machine collectively, and has a function of obtaining density data for determining the quantity of supplement of developing solution.

The processing section 16 has a developing vessel 46, a bleaching and fixing vessel 47 and washing vessels 48 and 49 arranged side by side. The photosensitive material 24 is developed, bleached, fixed and washed with the processing solutions in those vessels, and then delivered to the drying section 18. Supplementing tanks 60, 62 and 64 are disposed below the developing vessel 46, the bleaching and fixing vessels 47 and the washing vessels 48 and 49 to supplementarily supply the processing solutions into those vessels as necessary.

In the drying section 18, the photosensitive material 24 is dried, and then delivered to a take-out tray 54.

Figure 2:
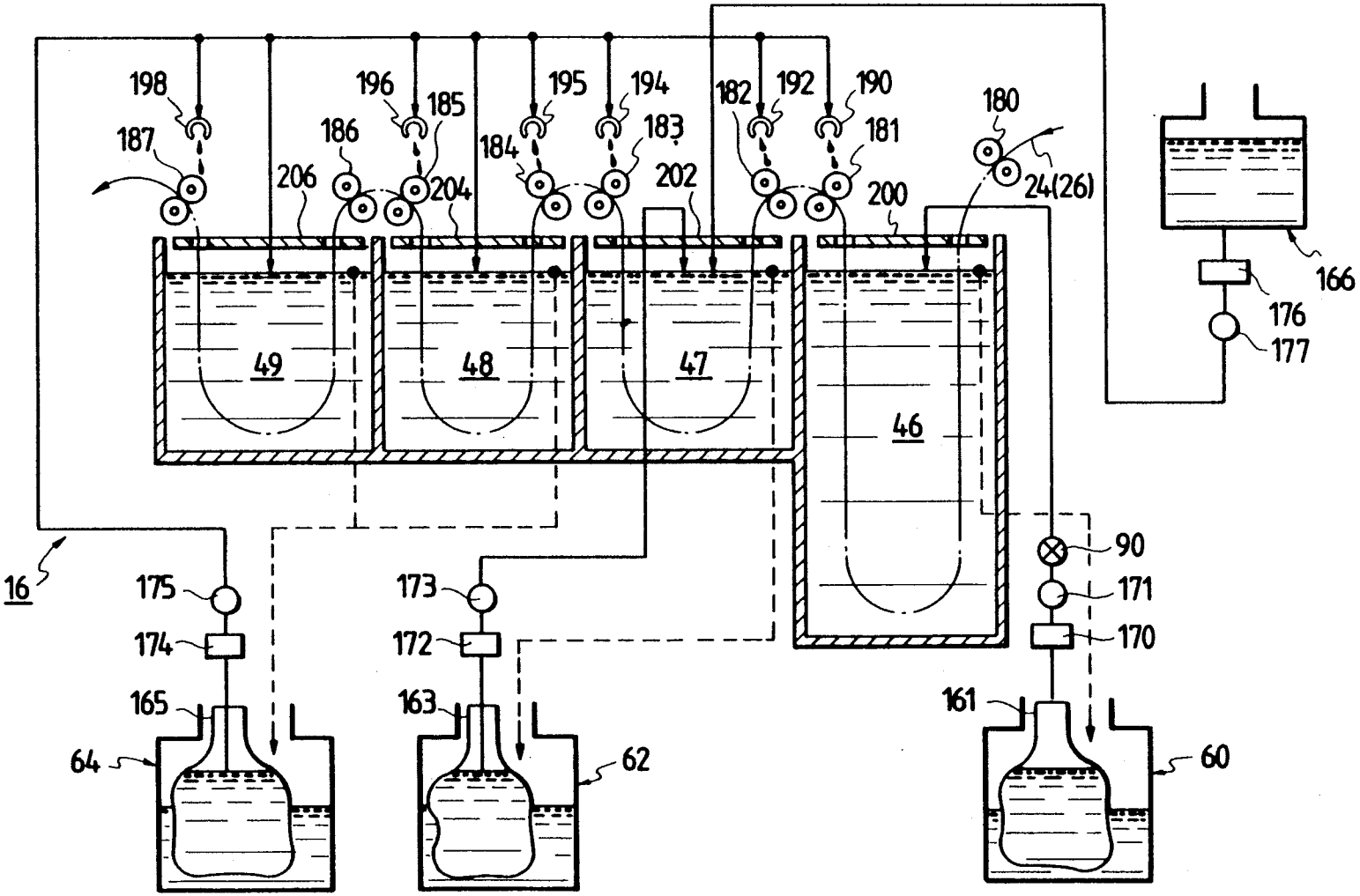
FIG. 2 is a diagram showing the arrangement of a processing section of a color copying machine.

FIG. 2 is a diagram showing the arrangement of the processing section 16 in more detail.

The processing section 16 includes the developing vessel 46 for developing an exposed photosensitive material 24, the bleaching and fixing vessel 47 for bleaching and fixing the photosensitive material 24 thus developed, and the washing vessels 48 and 49 for washing the photosensitive material 24 thus fixed with water. These vessels 46, 47, 48 and 49 have shutters 200, 202, 204 and 206, respectively, so as to minimize the contact area of the air and the solution surface in each of the vessels.

The processing section 16 further includes the tank 60 for supplementarily supplying the developing solution into the developing vessel 46, a tank 166 for supplementarily supplying a bleaching solution into the bleaching and fixing vessel 47, a tank 61 for supplementarily supplying a fixing solution into the vessel 47, and a tank 64 for supplementarily supplying a washing solution (or water) into the washing vessels 48 and 49. Those processing solutions are suitably supplied into the respective vessels as required. More specifically, the processing solutions in the tanks 60, 62, 64 and 166 are supplementarily supplied through filters 170, 172, 174 and 176 into the vessels 46, 47, 48 and 49 by pumps 171, 173, 175 and 177, respectively, as indicated by the solid lines in FIG. 2. The developing solution tank 60, the fixing solution tank 62, and the washing solution tank 64 accommodate deformable bags of vinyl resin or the like which contain the respective processing solutions. In each of the tanks 60, 62 and 64, a space is provided between the bag and the tank to receive the processing solution flowing over the respective vessel.

The water tank 64 supplies water to the washing vessels 48 and 49, as described above. In addition, the water tank supplies water to cleaning devices 190 through 198 which are adapted to clean conveying roller pairs 181, 181, 182, 184, 185 and 187 used to convey the photosensitive material 24 through the vessels. That is, the water is supplied through the cleaning devices 190 through 198 to the conveying roller pairs 181, 182, 183, 183 and 187 to clean the latter.

The control device 45 will be described with reference to FIG. 3 in more detail.

Figure 3:
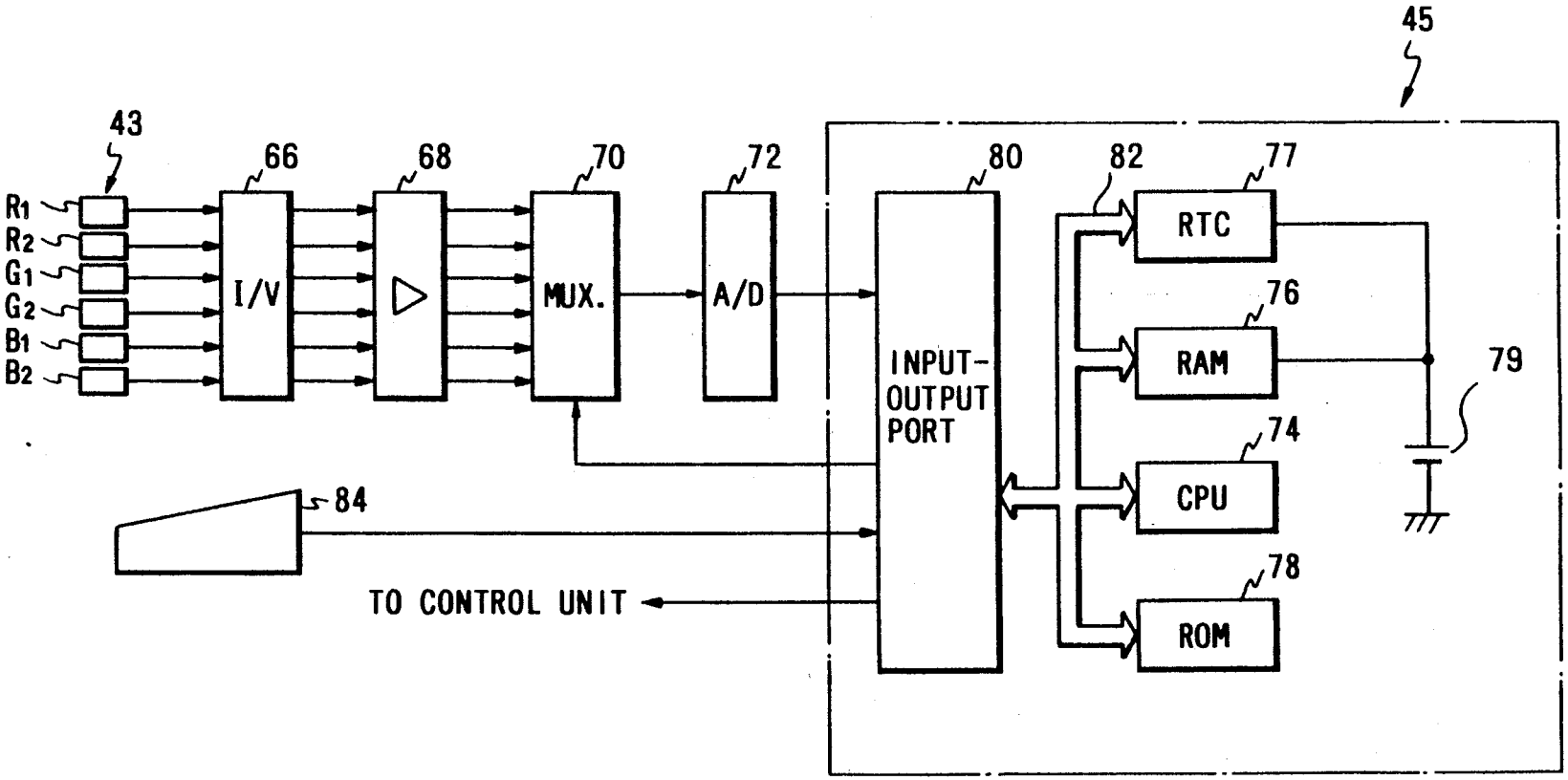
FIG. 3 is a block diagram showing the arrangement of a control device in the color copying machine.

As shown in FIG. 3, the plurality of photosensors 43, which receive light reflected from the shutter 44 (light reflected from the color original) are connected through a current-voltage conversion circuit 66 and a voltage amplifier circuit 68 to a multiplexer 70. The output of the multiplexer 70 is connected through an A/D (analog-to-digital) converter 72 to the control device 45.

The control device 45 includes a CPU 74, a RAM 76, a ROM 78, an input/output port 80, a clock IC (RTC) 77 and buses 82 such as data buses and control buses through which the above elements are connected to one another. The RAM 76 and the RTC 77 are provided with a battery 79 as a backup power source. The output signal line of the A/D converter 72 is connected to the input/output port 80. The input/output port 80 is connected to the multiplexer 70 so as to control the switching of the input and output signals of the photosensors 43 in the multiplexer 70.

A variety of setting switches (not shown) are connected through signal lines to the input/output port 80 so as to input a variety of setting data such as (1) magnification setting data, (2) number-of-copies setting data, (3) sheet size setting data, (4) photosensitive-material selecting data, (5) density adjusting data, (6) color-adjusting-value setting data and (7) start setting data.

Control signals for controlling the operations of various parts of the copying machines such as (1) exposing section control signals (a scan control signal and a color density control signal), (2) a sheet supplying section control signals (a photosensitive material conveyance control signal and a photosensitive material cutting control signal) and (3) processing section control signals (processing solution supplying signals, a temperature control signal, and a photosensitive material conveyance signal) are outputted through the input/output port 80.

Thus, according to the setting data inputted through an operating panel 84, the control device 45 collectively controls the scanning of the color original 32 and the conveying and the processing of the photosensitive material 24 in a synchronization mode, so that various operations are achieved with high accuracy.

In addition, the control device 45 controls the quantity of processing solution which is supplementarily supplied into the developing vessel 46, and the time of supplementary supply. That is, the control device 45 controls ordinary supplementing carried out whenever a photosensitive material 24 is processed, evaporation supplementing carried out to supplementarily supply developing solution to compensate for the amount evaporated during adjustment of the temperature of the developing solution, off-time supplementing carried out to supplementarily supply developing solution to compensate for the amount evaporated when the copying machine is not in use, and level detection supplement carried out to supplementarily supply developing solution when it is detected that the level of the developing solution in the developing vessel 46 is lower than a predetermined value when the power switch is turned on or during operation.

Next, the processing-solution supplementing apparatus will be described.

Figure 4:
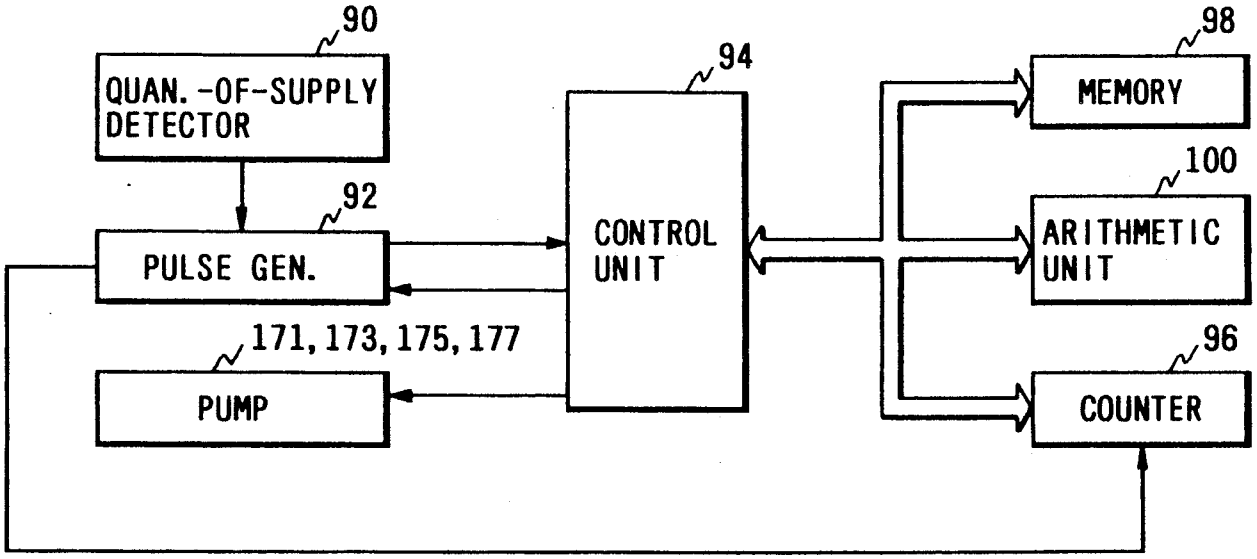
FIG. 4 is a block diagram showing the arrangement of a processing solution supplementing apparatus.

FIG. 4 is a block diagram showing the arrangement of the processing-solution supplementing apparatus.

The apparatus includes a quantity-of-supply detector 90 for detecting the quantity of processing solution supplied to a processing solution vessel (hereinafter referred to as a quantity of supply when applicable), a pulse generator 92 for generating pulses with a predetermined period according to the quantity of processing solution detected by the quantity-of-supply detector 90 for converting a calculated quantity of supplement of processing solution into a pulse signal, a control unit 94 for controlling suspension of the operations of the pumps 171, 173, 1754 and 177 according to the number of pulses generated, a counter 96 for counting the number of pulses generated for a predetermined period of time, a memory 98 for temporarily storing the difference between the number of pulses generated by the pulse generator and the number of pulses concerning the control of the pumps 171, 173, 175 and 177, and an arithmetic unit 100 for adding the number of pulses thus stored to the number of pulses corresponding to the next calculated quantity of supplement.

The quantity-of-supply detector 90 may be a flow rate sensor, for instance, which is provided at a processing solution supplying outlet through which a processing solution is supplementarily supplied to the respective processing solution vessel. The detector 90 is connected to the pulse generator 92 so that the detection signal is applied to the latter.

The control unit 94 may be a CPU, for instance, which calculates a quantity of supplement of processing solution, and applies it to the pulse generating means 92.

The pulse generator 92 produces pulses according to the detected quantity of processing solution and the calculated quantity of processing solution, and applies the pulses thus produced to the control unit 94 and the counter 96.

The control unit 94 is connected to the memory 98, the arithmetic unit 100, and the counter 96. The control unit 94 controls the operations of the pumps 171, 173, 175 and 177 while feeding back the quantities of supplement according to the numbers of pulses corresponding to the quantities of supplement, the numbers of pulses corresponding to the quantities of supply, the number of pulses produced for the predetermined period of time, the differences between the numbers of pulses corresponding to the quantities of supply and the numbers of pulses concerning control of the pumps, and the sums of the numbers of pulses corresponding to the quantities of supply and the numbers of pulses corresponding to the next calculated quantities of supplement.

The operation of the control unit 94 will be described with reference to the flow chart of FIG. 5.

A quantity of supplement Re is calculated by an amount-of-supplement control routine in Step 1, and then this value is inputted in Step S2.

The quantities of processing solutions which, in the preceding supplement, have not been supplied yet because of the capacities of the pumps 171, 173, 175 and 177 with respect to the calculated quantities of supplement (hereinafter referred to as "quantities of non-supplement" when applicable) have been stored in the memory 98. In addition, the differences between the numbers of pulses corresponding to the preceding quantities of non-supplement and the numbers of pulses concerning control of the pumps have been stored in the memory 98. Therefore, in Step S3, in the arithmetic unit 100 the difference between the number of pulses corresponding to the preceding quantity of non-supplement and the number of pulses concerning the control of the pump is added to the quantity of supplement inputted, thereby to calculate the number of pulses corresponding to a new quantity of supplement.

Figure 6:
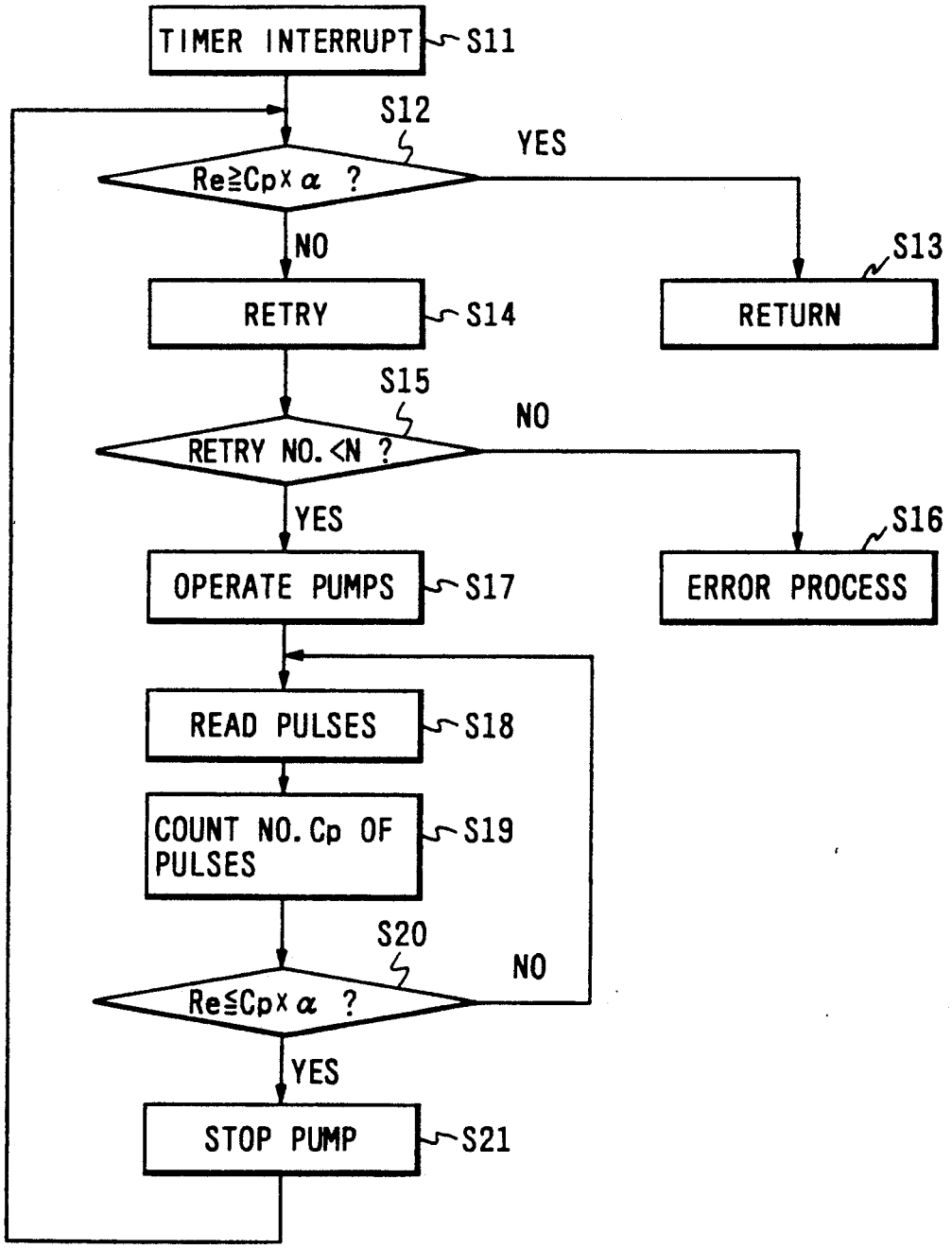

In Step S4, a supplement time Tp which may be required for supplying the processing solution as much as the new quantity of supplement is calculated. In Step S5, the timer is turned on, and after the time Tp has passed, an timer interrupt routine as shown in FIG. 6 is effected. The time Tp is at least an estimated supplement time, and it is set to the time which elapses until processing the next photosensitive material is started. The time Tp thus determined is stored in the memory 98.

When the timer is turned on in Step 5 as described above, the pumps 171, 173, 175 and 177 are operated in Step S6.

In step S7, pulses are read in correspondence to the quantity of supply detected by the flow rate sensor, and in Step S8 the number of pulses Cp is measured.

In Step S9, the calculated quantity of supplement Re is compared with the quantity of supplement (Cp $\alpha$) which has been supplied (hereinafter referred to as "an actual quantity of supplement" when applicable), in which $\alpha$ is a coefficient for converting the number of pulses into a quantity of supplement. When the actual quantity of supplement (Cp $\alpha$) is smaller than the calculated quantity of supplement Re, the supplying of the processing solution is continued, and Step S7 is effected again to read pulses in correspondence to the quantity of supplement. When the actual quantity of supplement (Cp $\alpha$) reaches the calculated quantity of supplement Re, in Step S10 the pumps 171, 173, 175 and 177 are stopped.

In the case when supplement has been finished before the lapse of the time Tp, it is unnecessary to start the timer interrupt routine.

The timer interrupt routine will be described with reference to the flow chart of FIG. 6.

Upon start of the pumps 171, 173, 175 and 177, the timer is turned on. In the time Tp, the timer interrupt routine starts in Step S11. In Step S12, the calculated quantity of supplement Re is compared with the actual quantity of supplement (Cp $\alpha$) which has been actually supplied. When & the actual quantity of supplement (Cp $\alpha$) becomes equal to or larger than the calculated quantity of supplement Re, the processing solution will have been supplied in the calculated quantity of supplement. In this case, in Step S13 the control shown in FIG. 5 is effected again, so that in Step S10 the pumps 171, 173, 175 and 177 are stopped. Thus, the supplement has been accomplished.

When in Step S12, the actual quantity of supplement (Cp $\alpha$) is smaller than the calculated quantity of supplement Re, in Step S14 a retry process is carried out to correct the calculated quantity of supplement, and a retry number is read.

In Step S15, the retry number thus read is compared with a preset retry number N. When the former is larger than the latter, in Step S16 an error processing routine is effected, and it is determined that the apparatus is out of order.

Figure 5:
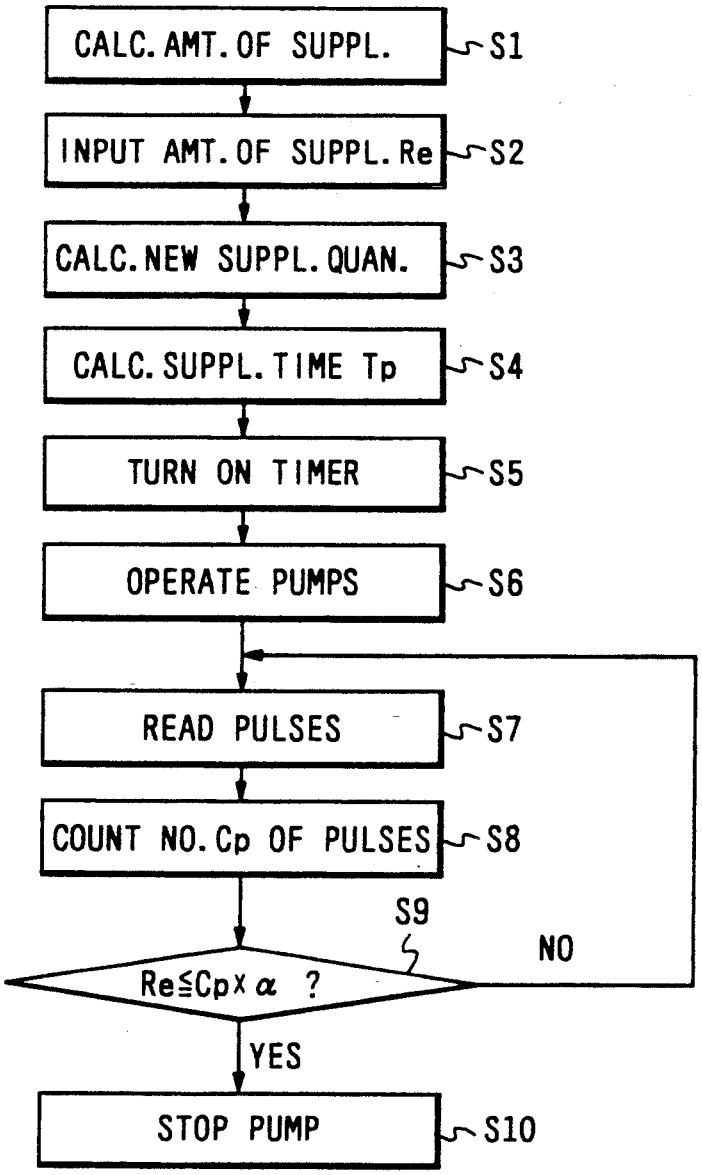
FIGS. 5 and 6 are flow charts for a description of the control of supplementation.

When, in Step S15, the retry number is smaller than the preset retry number N, in Steps S17 through S21 the same operations are carried out as in Steps S6 through S10 in FIG. 5. Thus, the supplement has been ended.

Figure 7:
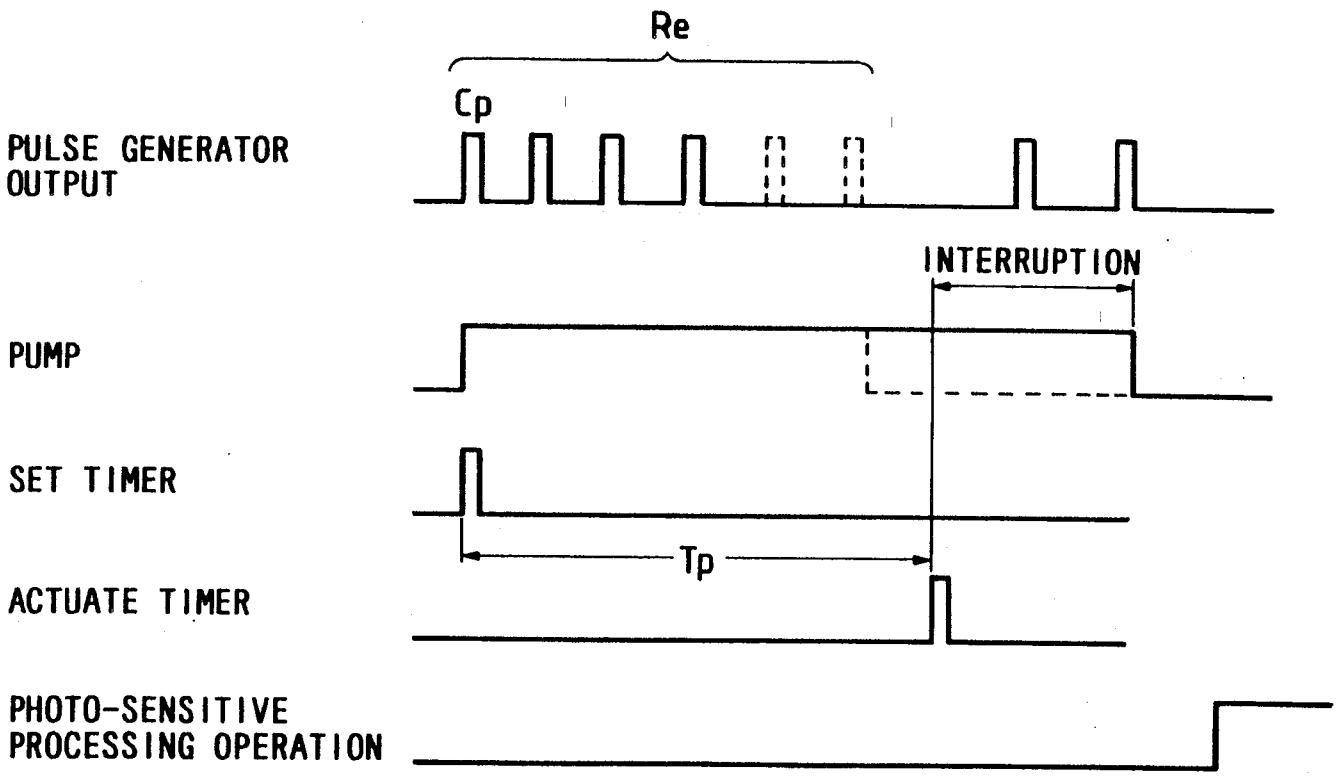
FIG. 7 is a timing chart for a description of the control of supplementation.

The timer interrupt routine will be further described with reference to FIG. 7. FIG. 7 is a timing chart showing the start of the timer interrupt routine, in which the solid line indicates the start time and the dotted line, other than the start time.

In the case where six pulses corresponds to the calculated quantity of supplement Re, as indicated by the dotted line, the quantity-of-supplying detector 90 detects the quantity of supply, and the pulse generator 92 produces six pulses, the control unit stops the pumps 171, 173, 175 and 177. Thus, the proper amount supplementing has been achieved.

If, on the other hand, only four pulses are generated in correspondence to the quantity of supply, as indicated by the solid line, then before completion of the supplement the time Tp elapses from the start of the pumps and the timer interrupt routine starts. Upon the start of the timer interrupt routine, the control unit 94 applies the pump operating signal to the pumps 171, 173, 175 and 177 to again operate the latter. When, after the start of the timer interrupt routine, it is detected that the processing solution has been supplied in a quantity of supply corresponding to two new pulses, the timer interrupt routine is ended. Thus, the supplementing procedure is ended. The time Tp for starting the timer interrupt routine is selected in a range of from the period of time which elapses from the start of the pump until the end of the estimated supplement time to the period of time which elapses from the start of the pump until the start of the next photosensitive processing operation.

Thus, in accordance with the invention, in calculating the quantity of supplement of processing solution, the quantity of supply is detected and converted into pulses with a predetermined period, and when the number of pulses reaches a predetermined value, the operation of the processing solution supplying means is suspended, whereby the processing solution can be supplementarily supplied accurately in an amount equal to the calculated quantity of supplement.

Any error in the quantity of supplement attributed to a lack of capacity of the processing solution supplying means is stored as a number of pulses, so that, in the next operation of supplementarily supplying the processing solution, the number of pulses corresponding to the error is added to the number of pulses corresponding to the calculated quantity of supplement to control the operation of the processing solution supplying means. Thus, the error is eliminated by repeatedly carrying out the supplement.

Furthermore, in the invention, the time of stopping the operation of the processing solution supplying means is controlled according to the number of pulses corresponding to the quantity of supply of processing solution or the number of pulses detected for a predetermined period of time. Therefore, the apparatus of the invention is free from the difficulty of the process solution supplying means being kept in continuous operation when the number of pulses varies greatly, for instance, if the apparatus is out of order.

Thus, with the apparatus of the invention, the processing solution can be supplied in the calculated quantity of supplement with high accuracy and with high reliability.

What is claimed is:

1. A processing solution supplementing apparatus for supplementarily supplying a processing solution into a processing vessel for processing a photographic photosensitive material, comprising:

detecting means for detecting a quantity of supply of said processing solution;

pulse generating means for producing pulses with a predetermined period in correspondence to said quantity of supply thus detected;

arithmetic means for calculating the number of pulses corresponding to the quantity of processing solution to be supplied supplementarily; and control means for controlling a time of stopping the operation of processing solution supplying means according to the number of pulses thus produced and the number of pulses calculated by said arithmetic means.

2. A processing solution supplementing apparatus for supplementarily supplying a processing solution into a processing vessel for processing a photographic photosensitive material, comprising:

pulse generating means for converting a calculated quantity of supplement of said processing solution into pulses;

processing solution supplying means a time of operation of which is controlled according to a predetermined number of pulses;

memory means for temporarily storing a difference between a number of pulses produced by said pulse generating means and a number of pulses applied to control said processing solution supplying means;

arithmetic means for adding the number of pulses thus stored to a number of pulses corresponding to a next calculated quantity of supplement of said processing solution; and control means for controlling the operation of said processing solution supplying means according to a result of operation by said arithmetic means.

3. A processing solution supplying apparatus for supplementarily supplying a processing solution into a processing vessel for processing a photographic photosensitive material, comprising:

detecting means for detecting a quantity of supply of said processing solution;

pulse generating means for producing pulses with a predetermined period in correspondence to said quantity of supply thus detected;

counting means for counting said pulses produced for a predetermined period of time; and control means for controlling a time of stopping the operation of said processing solution supplying means according to a number of pulses thus produced or a number of pulses thus counted.

4. A method for supplementing processing solution for into a processing vessel for processing a photographic photosensitive material, comprising the steps of:

detecting a quantity of supply of said processing solution;

producing pulses with a predetermined period in correspondence to said quantity of supply thus detected;

calculating the number of pulses corresponding to the quantity of processing solution to be supplied supplementarily; and controlling a time of stopping supplying said processing solution to the number of pulses thus produced and the number of pulses thus calculated.

5. A method for supplementing processing solution for into a processing vessel for processing a photographic photosensitive material, comprising the steps of:

converting a calculated quantity of supplement of said processing solution into pulses;

supplying process solution for a time controlled according to a predetermined number of pulses;

temporarily storing a difference between a number of pulses produced by said pulse generating means and a number of pulses applied to control supplying of said processing solution supplying means;

adding a number of pulses thus stored to a number of pulses corresponding to a next calculated quantity of supplement of said processing solution; and controlling supplying of said processing solution supplying means according to a result of said step of adding.

6. A method for supplementing processing solution for into a processing vessel for processing a photographic photosensitive material, comprising the steps of:

detecting a quantity of supply of said processing solution;

producing pulses with a predetermined period in correspondence to said quantity of supply thus detected;

counting said pulses produced for a predetermined period of time; and controlling a time of stopping the supplying of said processing solution according to a number of pulses thus produced or a number of pulses thus counted.

7. A method for supplementing processing solution for into a processing vessel for processing a photographic photosensitive material, comprising the steps of:

converting a calculated quantity of supplement of said processing solution into pulses;

supplying process solution for a time controlled according to a predetermined number of pulses;

temporarily storing a difference between a number of pulses produced by said pulse generating means and a number of pulses applied to control supplying of said processing solution supplying means;

adding a number of pulses thus stored to a number of pulses corresponding to a next calculated quantity of supplement of said processing solution; and controlling supplying of said processing solution supplying means according to a result of said step of adding.

* * * * *